United States Patent [19]

Dutt

[11] Patent Number: 4,657,806

[45] Date of Patent: Apr. 14, 1987

[54] WET PRESS PAPERMAKERS FELT

[75] Inventor: William H. Dutt, Rensselaer, N.Y.

[73] Assignee: Albany International Corp., Menands, N.Y.

[21] Appl. No.: 715,828

[22] Filed: Mar. 25, 1985

[51] Int. Cl.[4] ..... D03D 3/00

[52] U.S. Cl. ..... 428/226; 428/234; 428/235; 428/237; 428/238; 428/239; 428/280; 428/282; 428/308.4

[58] Field of Search ..... 427/244, 245, 336, 352, 427/389, 389.9; 428/308.8, 239, 304.4, 226, 308.4, 280, 281, 282, 234, 237, 235, 238; 521/61, 63; 162/136; 210/507, 508; 28/107, 110

[56] References Cited

U.S. PATENT DOCUMENTS

| | | | |
|---|---|---|---|
| 2,474,201 | 6/1949 | Raymond et al. | 521/61 |
| 2,673,825 | 3/1954 | Biefeld et al. | 521/61 X |
| 2,719,795 | 10/1955 | Nottebohm | 521/61 X |
| 2,826,509 | 3/1958 | Sarbach | 521/61 X |
| 4,070,519 | 1/1978 | Lefkowitz et al. | 428/235 |
| 4,283,454 | 8/1981 | Buchanan | 428/282 X |
| 4,357,386 | 11/1982 | Luciano et al. | 428/234 |
| 4,500,588 | 2/1985 | Lundström | 428/235 X |
| 4,529,643 | 7/1985 | Lundström | 428/282 X |

*Primary Examiner*—Thurman K. Page

*Attorney, Agent, or Firm*—Kane, Dalsimer, Sullivan, Kurucz

[57] ABSTRACT

The disclosure is of a method of preparing a papermakers wet-press felt fabric, felts made therefrom and their use, as wet-press felts on papermaking machines. By the method of the invention, there is obtained a method of making a papermakers press felt of controlled porosity while at the same time maintaining a high level of void volume and permeability in a loaded nip of a paper machine press.

2 Claims, 4 Drawing Figures

WET PRESS PAPERMAKERS FELT

BACKGROUND OF THE INVENTION

1. Field of the Invention

The invention relates to papermakers felts and more particularly relates to a wet press felt for use in the press section of a papermaking machine and the method of its fabrication.

2. Brief Description of the Prior Art

The modern papermaker employs a highly sophisticated machine to make paper, which is named rather appropriately a "papermaking machine". The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web having a solids content of circa 18 to 25 percent by weight. The formed web is carried into a wet press felt section and passed through one or more nip presses on a moving press felt to remove sufficient water to form a sheet having a solids content of 36 to 44 percent by weight. This sheet is then transferred to the dryer section of the papermaking machine where dryer felts press the paper sheet against hot, steam-heated dryer cylinders to obtain about 92 to 96 percent solids content.

The clothing employed on the papermaking machine must perform a widely diverse range of functions, according to the position on the machine, i.e., forming, press or dryer section. In view of the diversity of functions, the clothing for use in each section of the machine must be manufactured to meet specific design requirements essential to the particular section. In the absence of meeting the specific felt design requirements demanded in each section of the machine, the overall operation of the machine will be unsatisfactory. Optimum operating lives of the felts will not be achieved, product quality may be adversely affected, machine speeds may be lowered or drying efficiency may be impeded.

Those skilled in the art have long appreciated that the efficiency of water removal in the wet press section of the papermaking machine is critical to overall efficiency in the papermaking process. This is because, first a large amount of water must be removed from the sheet at the presses to realize a good drying economy. Secondly, greater efficiency in water removal creates a drier and hence stronger sheet less susceptible to breaking. A large variety of clothing constructions have been proposed as papermakers felts advantageously employed in the press section of a paper-making machine. In fact, there has been a continual evolution of clothing constructions, corresponding to improvements in the papermaking machine itself. This evolution began with the early woven felt, woven of spun yarn and then mechanically felted or fulled. A later development was found in the "Batt-on-Base" construction consisting of a woven fabric base and a batt surface attached by needling. The needled batt-on-base felts are widely used today and have been said to be the "standard of the industry". However, a wide variety of other constructions are available, including non-woven press felts.

Important physical properties of a papermakers press felt are measured by four test measurements. They are:

1. Saturated moisture: a measure of the amount of water absorbed by the felt under static conditions. Expressed as pounds of water absorbed per pound of felt, saturated moisture is an excellent indicator of the ability of a felt to receive water from the sheet in the nip.

2. Vacuum dewatering: measures the ability of a felt or fabric running on a press to release water to a suction pipe.

3. Air permeability: measured in a dry felt, is expressed as cfm/sq. ft. of felt at 0.5 in. water pressure ($m^3/m^2$ per hr. at 10 mm water gauge).

4. Flow resistance: the water permeability of the felt or fabric.

Generally, the batt-on-base felts are advantageous in all four parameters, compared to the earlier conventional woven felt. However, as the speed of the papermaking machines has increased, so has the need for press felts which show an advantage in one or more of the desired physical properties.

One type of press felt which has been suggested is a composite of a woven or non-woven fabric base bearing a surface layer of a flexible, open-cell, polymeric resin foam. This layer, acting like a sponge would enhance the removal of water from the paper sheet. In addition, the inherent thermal insulation provided by the foam layer would impart some protection to the underlying fabric structure which is normally exposed completely to the degradative, hot water being pressed from the paper sheet. These composite felts have also shown good resistance to compaction. Representative of the prior art concerned with the latter composite papermakers felts are the disclosures found in U.S. Pat. Nos. 1,536,533; 2,038,712; 3,059,312; 3,399,111; and 3,617,442. In general, the papermakers felts of the prior art which comprise a composite laminate of a textile and a polymeric resin layer have not been completely satisfactory in regard to their resistance to wear, delamination and long term resistance to compaction. Apparently, the diverse nature of the two components enhances degradation of the overall composite. Further, the presence of a seam in the foam layer serves to provide a weak point in the construction.

The composite structure of the papermakers felts of the present invention are an improvement over many of the prior art composite felts in regard to their resistance to wear, delamination and long term compaction resistance. They are virtually seam free. In addition, the method of their manufacture is an improvement over prior art manufacturing processes for composite felts.

SUMMARY OF THE INVENTION

The invention comprises a papermakers felt, which comprises;

a base fabric of interwoven machine and cross-machine direction yarns; and a coating of a resilient, water-resistant, synthetic polymeric resin bonded to the base fabric;

said resin coating being water permeable by virtue of a plurality of channels penetrating the body of the coating.

The wet-press papermakers felts of the invention exhibit improved compression/recovery properties and are characterized in part by homogeneous, evenly distributed coating voids.

The invention also comprises the method of fabricating the papermakers felts of the invention, wherein void size and distribution are highly controlled.

DETAILED DESCRIPTION OF THE PREFERRED EMBODIMENTS OF THE INVENTION

Figure 1:
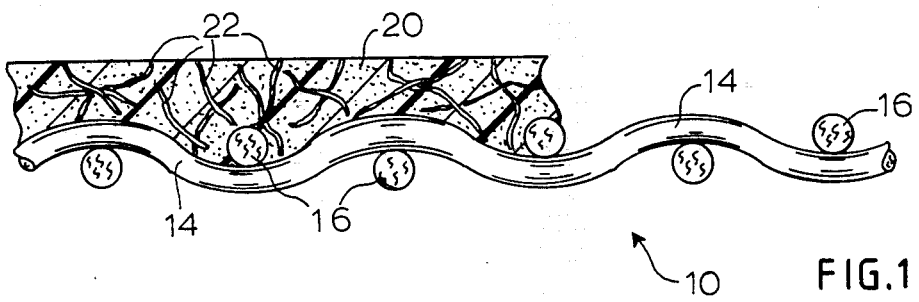
FIG. 1 is a cross-sectional side elevation, enlarged, of a portion of an embodiment wet-press fabric of the invention, in an initial stage of fabrication before curing of the polymeric resin layer.

FIG. 1 is a cross-sectional side elevation, enlarged, of an intermediate fabric 10 useful in a preparation according to the method of the invention for preparing the wet-press felt fabric of the invention. The fabric 10 comprises a base layer which may be any conventional press felt fabric.

As shown in FIG. 1, the base layer 12 is preferably of interwoven machine direction (warp) 14 and cross-machine direction (weft) 16 textile yarns. The yarns may be spun yarns, spun from synthetic or natural staple fibers such as staple fibers of wool, cotton, polyolefins, polyamides, polyesters, mixtures thereof and the like. Alternatively, the yarns 14, 16 may be multifilament yarns of the same synthetic or natural fiber materials. Preferably, the yarns 14, 16 are monofilament yarns of synthetic polymeric resins such as yarns of polyesters or polyamides and the like.

The particular weave employed in providing the base layer is not critical and any conventional felt weave may be employed. Thus, the base layer may be a single layer or multi-layered weave construction and may include filling yarns or picks to control permeability of the fabric 10.

Advantageously the denier of the yarns and the density of the weave is selected to provide a base layer weight of from about 4 to about 30 oz./square yard for optimum strength.

Figure 2:
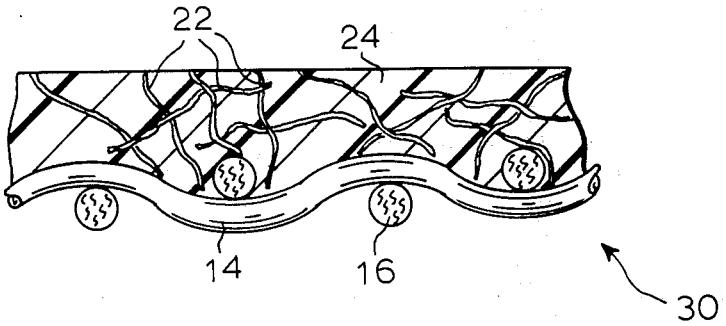
FIG. 2 is a view of a portion of the fabric shown in FIG. 1, after curing of the polymeric resin layer.

A top layer comprises a coating of a synthetic non-cellular, polymeric resin 20 containing a dispersion of solvent-removable chopped fibers 22. The resin 20 is curable or cross-linkable to a solvent-resistant state as shown in FIG. 2. The fabric 30 shown in FIG. 2 is the fabric 10 wherein resin 20 has been cured to obtain the cured resin 24. The resin 24 may be any solvent-resistant, cured resin of a synthetic polymeric resin 20. Representative of such resins 20, 24 are elastomeric resins of polyethylene, polyurethanes, including polyether and polyester polyurethanes, polyisocyanurates and the like. The method of preparing such resins and for coating them on substrates is well-known to those skilled in the art. The thickness of the coating or resin 24 is advantageously within the range of from 0.050" to 0.200". The solvent-removable fibers 22 are either synthetic polymeric resin staple or natural fibers, which may be dissolved with specific solvents, to which the resin 24 and yarns 14, 16 are solvent resistant. Representative of such solvent removable fibers are fibers of wool, ethyl cellulose, polystyrene, polycarbonate and polystyrenemethylmethacrylate which are readily dissolved in dry cleaning solvents or aqueous acid or alkali mediums (see U.S. Pat. No. 3,311,928). Fibers of polyvinyl alcohol may be used and are removable by dissolution in water; as are fibers of poly(ethylene oxide); see U.S. Pat. No. 4,097,652. Fibers of certain polyethylenes are also usable, being removable by dissolution in hot water (see U.S. Pat. Nos. 2,714,758 and 3,317,864). Wool fibers are inexpensive, and can be removed with 5% NaOH at 150° F. to 212° F. without damage to the base yarns or the resin 24.

Alternatively, the solvent-removable fibers need not be chopped fibers admixed with the resin 20. Any other procedure may be followed whereby the fibers (or other solvent-removable material as hereinafter described) may be employed so as to leave void spaces or channels in the cured resin 24 upon removal. For example, a tangle of mainly continuous solvent-removable yarns or filaments may be placed on the surface of a base structure. The resin 20 coating is then applied so as to penetrate the tangle and into a portion of the base structure, bonding the tangle to the base. Upon removal of the solvent-removable material, voids are left in the cured resin 24. The tangle might resemble a pot scrub pad. The density of the tangle would determine the degree of voids left. Also, the base fabric may be fabricated to include the solvent-removable fibers in such a way that the fibers project like pile or tufts. The tufts could be cut or left uncut. The pile side of the fabric can then be coated with the resin 20, penetrating at least part way into the base fabric. Upon removal of the solvent-removable fibers, voids are left in the cured resin 24. The density of the piles or tufts would determine the degree of voids.

Although the use of solvent-removable fibers are preferred in the method of the invention, other solvent-removable materials may be used as the solvent-removable component. Representative of such, less preferred materials are solid granules or particles of solvent-removable, inert chemical components which may be dispersed homogeneously throughout the resin 20, 24 described above before curing. The term "inert" as used herein means that the chemical compound does not chemically react with the other components of the fabrics of the invention. Representative of such inert, solvent removable chemical compounds are dissolvable inorganic salts or the hydrates thereof or oxides thereof. The action of such a salt may generally be any of the alkaline metals and preferably any of the non-toxic alkaline earth metals, column 1A and 2A, respectively, of the Periodic Table.

The solvent removable components, whether a chemical compound in granular or particulate form or in the form of a textile fiber, is advantageously mixed and homogeneously dispersed with the resin 20 prior to coating the fabric substrate, employed in making the fabrics of the invention. The proportion of solvent removable component dispersed in the solvent resistant resins will depend on the volume of the solvent removable component and the desired void volume in the fabric of the invention. The optimum proportions may be determined by trial and error techniques. However, in general the proportions in the blend will be within the ratio of from about 10 to about 100 parts by weight of solvent removable component for each 100 parts by weight of the solvent resistant, resin 24. Thus, the fabricator has infinite control of the void volume and void distribution of the final fabric product in making the fabrics of the invention.

Figure 3:
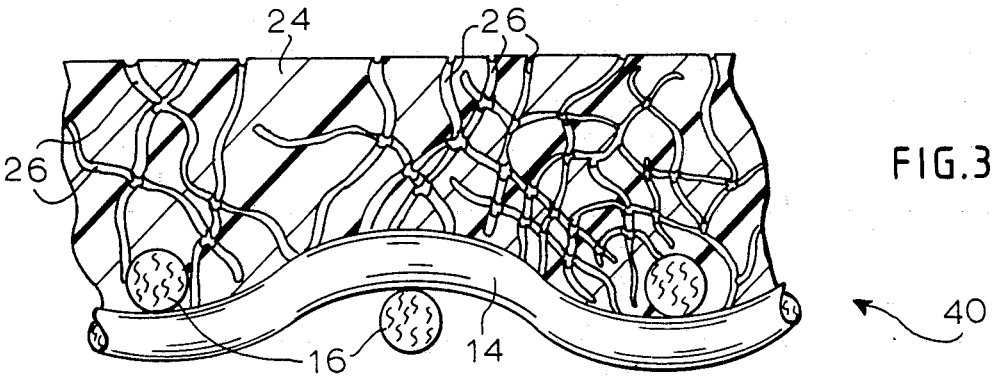
FIG. 3 is a cross-sectional, side elevation of a portion of a preferred embodiment fabric of the invention.

In a final step of the method of the invention, the solvent fugitive or removable component is dissolved or leached out of the resin 24 layer of fabric 30 leaving void spaces in the fabric. This may be done by washing the fabric 30 in the appropriate solvent, under appropriate dissolution conditions. The resulting wet press felt fabric 40 as shown in FIG. 3 may then be dried and made into a belt 50 for use on a papermaking machine. FIG. 3 is a side elevation, enlarged, of a portion of an embodiment fabric 40 of the invention, prepared as described above and wherein the solvent-removable fibers 22 have been dissolved away leaving open channels 26 which penetrate the cured resin 24, making the fabric 40 water permeable via the voids created in the resin 24. The channels 24 receive water from carried wet paper, as it passes through the nip of the wet press on a papermakers machine. The received water is able to drain through the fabric 40 by gravity.

Figure 4:
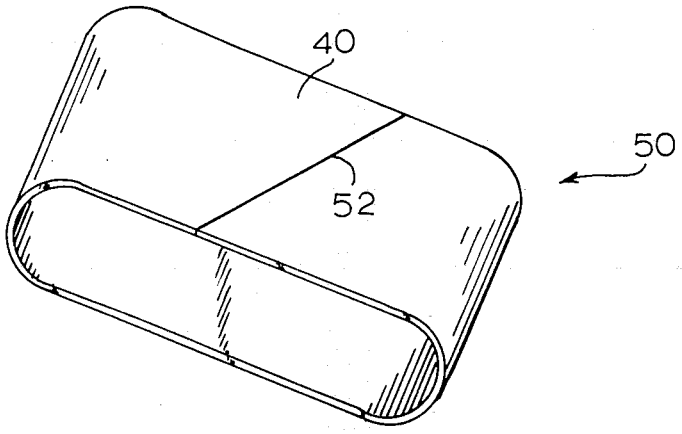
FIG. 4 is an isometric view of a wet-press belt made from the fabric of FIG. 3.

FIG. 4 is a view-in-perspective of an embodiment wet press belt 50 made by making endless a fabric 40 made by the method of the invention. The fabric 40 is made endless by joining the ends of the fabric 40 at seam 52, using conventional seaming techniques. The fabric 40 can be woven endless or joined to make felt endless.

When the fabric of the invention is made up of an endless belt for use on a papermaking machine, the resulting controlled void volume felts display high density, high compaction resistance and less flow resistance under pressure than standard production felts and control samples.

Those skilled in the art will appreciate that many variations of the above-described preferred embodiments may be made without departing from the spirit and scope of the invention. For example, the felts of the invention may be treated by heat-setting, with chemicals, etc., as conventionally done in the art to achieve particular properties. Also, those skilled in the art will appreciate that although the invention has been described herein in terms of a single type of wet felt press felt fabric, it applies to any textile felt construction, for example those described in U.S. Pat. Nos. 3,613,258 and 4,187,618.

What is claimed:

1. A papermakers wet-press felt, which comprses:

a base layer, which comprises a woven fabric of interwoven machine and cross-machine direction textile yarns; and a top layer coated on the base layer, said coating comprising a resilient, water-resistant, elastomeric, non-cellular, synthetic polymeric resin bonded to the base layer;

said resin coating being characterized in part by homogeneously distributed voids and being water permeable by virtue of a plurality of channels penetrating the body of the coating top layer.

2. The felt of claim 1 wherein said yarns are monofilament yarns.

* * * * *